US005913740A

United States Patent [19]

Miklos

[11] Patent Number: 5,913,740

[45] Date of Patent: Jun. 22, 1999

[54] FLAT BEAM AERODYNAMIC TENNIS RACQUET

[76] Inventor: Edward J. Miklos, 5536 Clarendon Dr., Solon, Ohio 44139

[21] Appl. No.: 08/995,851

[22] Filed: Dec. 22, 1997

Related U.S. Application Data

[60] Provisional application No. 60/053,798, Jul. 25, 1997.

[51] Int. Cl.[6] ..... A63B 49/02

[52] U.S. Cl. ..... 473/537; 473/520

[58] Field of Search ..... 473/537, 535, 473/536, 520, 521, FOR 171

[56] References Cited

U.S. PATENT DOCUMENTS

| | | | |
|---|---|---|---|
| 4,664,380 | 5/1987 | Kuebler . | |
| 4,725,059 | 2/1988 | Du Gardin et al. | 473/536 |
| 5,076,583 | 12/1991 | Hsu | 473/537 |
| 5,158,288 | 10/1992 | Chen et al. | 473/537 |
| 5,183,265 | 2/1993 | Umlauft et al. | 473/521 |
| 5,226,651 | 7/1993 | Du Gardin | 473/521 |
| 5,249,798 | 10/1993 | Miyamoto | 473/537 |
| 5,312,102 | 5/1994 | Stennett | 473/537 |
| 5,462,274 | 10/1995 | Takatsuka | 473/537 |
| 5,540,434 | 7/1996 | Garrett, Jr. et al. | 473/536 |

FOREIGN PATENT DOCUMENTS

| | | | |
|---|---|---|---|
| 477533 | 4/1992 | European Pat. Off. . | |
| 4031180 | 4/1992 | Germany . | |
| 40-5064670 | 3/1993 | Japan | 473/FOR 171 |
| 2150444 | 7/1985 | United Kingdom . | |
| WO 89/06558 | 7/1989 | WIPO . | |

OTHER PUBLICATIONS

Popular Science, Sep. 1985, p. 110 author: R. Stepler.
The Sporting Goods Dealer, May 1981.

*Primary Examiner*—Raleigh W. Chiu
*Attorney, Agent, or Firm*—Vickers, Daniels & Young

[57] ABSTRACT

A tennis racquet which is made up of a handle, a throat and a head. The head of the racquet is designed to increase power and control during play. The head includes at least one section having a varying thickness and width along the length of the head. The head can be designed such that the bottom section has a greater thickness, width and/or cross-sectional shape than the top section. The racquet head is also designed to shift the center of gravity of the racquet toward the handle of the racquet.

24 Claims, 2 Drawing Sheets

FLAT BEAM AERODYNAMIC TENNIS RACQUET

This patent application is based upon and claims priority on U.S. Provisional patent application Ser. No. 60/053,798 filed on Jul. 25, 1997, now abandoned.

FIELD OF THE INVENTION

The invention relates to the field of racquets and in particular, relates to an improved tennis racquet design which provides for improved racquet control and handling; however, the invention has broader applications and can be applied to a wide variety of types of racquets such as racquets for use in table tennis, racquetball, badminton, squash, etc. Although the invention has a broad range of applications, it will be described with particular reference to tennis racquets.

BACKGROUND OF THE INVENTION

Over the years, tennis racquets have been designed to hit the ball harder without sacrificing control of the ball when hit. Tennis racquets have been designed with a thicker head to make the racquet stiffer. It is believed that a stiffer racquet enables a player to hit the ball harder and faster. Such a design is shown in EPC 0477533. The tennis racquet has a thick head to reduce the deflection of the head when hitting the ball. It is believed that by reducing the deflection of the head, the power and accuracy imparted on the ball by a player is increased. The increased thickness of the head also reduces the twisting action of the head during play thus increasing the accuracy of play. The tennis racquet disclosed in the EPC patent incorporates a head configuration which increases the stiffness of the head and which resists torsional deformation during play.

Tennis racquets have also been designed to reduce vibration during play since such vibration adversely affects control of the ball during play. Many different strategies have been used to reduce vibration. These strategies have included the incorporation of vibration dampeners in the head of the racquet and/or on the string of the racquet. Another strategy includes the design of a racquet head which helps to suppress the vibration of the head. One such design is disclosed in U.S. Pat. No. 4,664,380. In such design, the cross-sectional height of the shaft is selected to be greater than the parallel thickness of the frame and the handle and the resonance frequency of to achieve such a resonance frequency, the head of the racquet is designed to be thicker than the handle of the racquet.

Tennis racquet head designs which have imparted stiffness and/or reduced vibration to the head during play have required the head thickness to be substantially increased. The increased head thickness, however, results in increased resistance during play which results in reduces swing speed and less racquet control especially during rapid racquet movement such as during volleying. In addition, the increased head size shifts the center of gravity of the racquet toward the top of the racquet. This shift in the center of gravity results in less racquet control.

In view of the state of the art for tennis racquets, there is a need for a racquet which has an improved aerodynamic profile and improved weight distribution to provide increased racquet control and power.

SUMMARY OF THE INVENTION

The present invention pertains to a new design for a tennis racquet having a new weight distribution technology system and will be specifically described with respect to such use; however, the invention has broader applications and the racquet improvements can be incorporated in any type of racquet. Past racquet designs included a racquet head of wide beam uniform thickness and having a weight distribution which was primarily concentrated in the head of the racquet. The weight distribution of these racquets made the racquet difficult to maneuver during play and could also contribute to player arm and wrist fatigue. The new and improved tennis racquet design of the present invention addresses and helps to resolve these past problems with tennis racquets. Accordingly, the new tennis racquet design redistributes the weight of the racquet by reducing the weight of the racquet head relative to the racquet handle. The weight reduction in the racquet head results in the center of gravity of the racquet to be position at the lower end of the racquet head and preferably below the racquet head. By moving the center of gravity of the racquet along the longitudinal axis of the racquet and toward the base of the racquet, the tennis player can more easily move the racquet during play. The change in center of gravity also improves the handling of the racquet and reduces stress on the arm and wrist of the player during play, resulting in reduced player fatigue and injury occurrences during play. Thus, the racquet is more player friendly.

In accordance with another aspect of the present invention, the new tennis racquet design incorporates improved aerodynamics. The racquet is designed to reduce air friction during play which can both slow the speed and handling of the racquet and cause the racquet head to vibrate or rotate during play. The improved aerodynamics of the racquet are primarily included in the throat and head of the racquet. Specifically, the throat and head of the racquet incorporates several design changes that greatly improve the aerodynamics of the racquet and also redistribute the weight of the racquet for better acceleration and control, earlier racquet preparation and easier directional changes on volleys without loss of power, creating a "glide effect." These design changes include the selection of different cross-sectional shapes of the racquet frame on various regions of the racquet. In addition, the materials forming the racquet frame may also be varied in various regions of the racquet.

In accordance with yet another aspect of the present invention, the racquet includes an improved string gripping surface. To improve gripping of the tennis ball during play, the strings are coated with a substance that strongly bonds to the strings and also grips a tennis ball during play. The improved griping increases the ability to produce a top spin, backspin and improves general ball control. One such substance is a rubber compound that can be applied by an aerosol spray. The compound is designed to be applied in a thin coat and will preferably last two or three matches before another coating should be applied. However, the coating may be a thicker coating that is applied to the strings before the racquet is strung. The coating may also be formulated to be applied by a brush.

In accordance with still yet another aspect of the present invention, the new racquet design reduces vibration during play. The reduction in vibration at least partially results from the redesign of the racquet frame shape and/or center of gravity redistribution. The racquet vibration can be further reduced by incorporating various type of vibration dampening materials into the racquet.

It is the primary object of the present invention to improve the performance of the tennis racquet during play.

It is another objection of the present invention is to improve the aerodynamics of the tennis racquet during play.

Yet another object of the present invention is to reduce the vibration of the racquet during play.

Still yet another object of the present invention is to improve the gripping of the tennis ball on the tennis racquet during play.

Another object of the present invention is the redistribution of the weight of the racquet to improve play.

Still another object of the present invention is to provide a tennis racquet which has differing material components for various regions of the fame of the racquet.

Yet another object of the present invention is to provide a tennis racquet that has a varying profile and/or cross-sectional shape.

These and other objectives and advances will become apparent to those skilled in the art upon reading the following descriptions together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENTS

Figure 1:
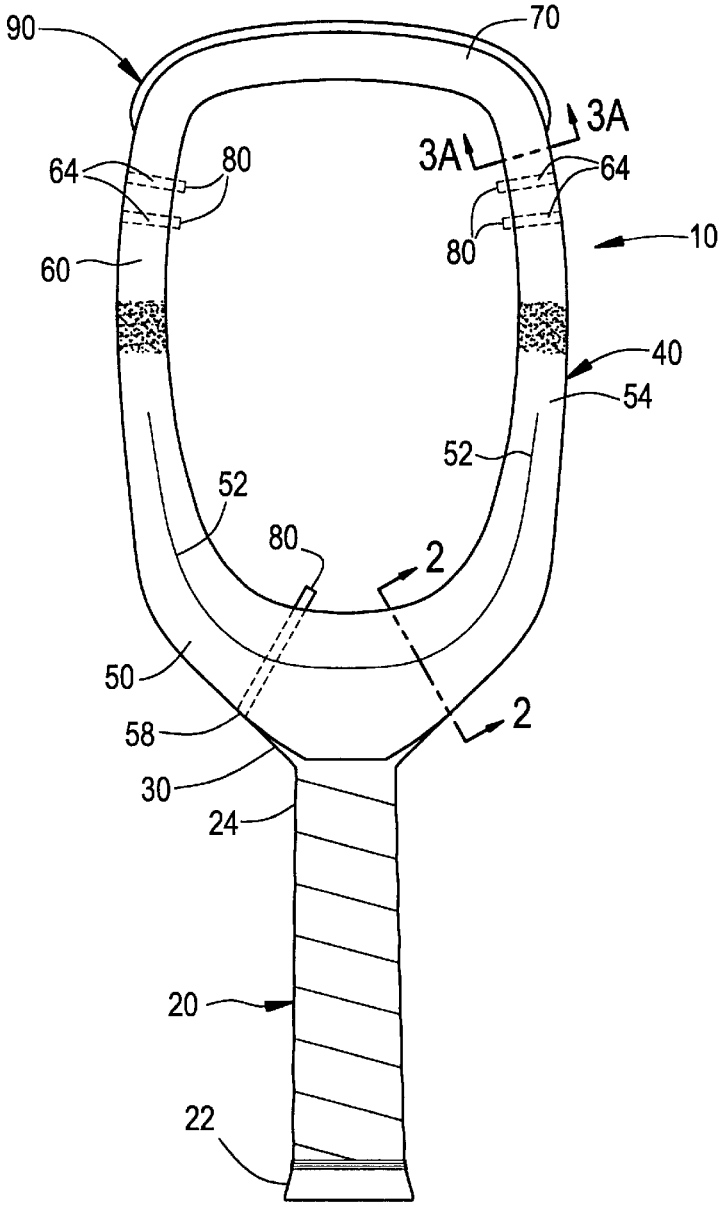
FIG. 1 illustrates a top plan view of the tennis racquet of the present invention.

Referring now to the drawings, wherein the showings are for the purpose of illustrating the preferred embodiments of the invention only and not for the purpose of limiting the same, in FIG. 1 illustrates the new tennis racquet design of the present invention. The tennis racquet 10 includes a new weight distribution technology system which improves the ease of maneuverability of the racquet during play and also reduces player arm and wrist fatigue during play.

The new tennis racquet design redistributes the weight of the racquet by redistributing the weight in the racquet head 40. The weight reduction in the racquet head results in the center of gravity of the racquet to be position at the lower end of the racquet head toward the handle below racquet head. By lowering the center of gravity of the racquet, the tennis player can more easily move the racquet during play. The change in center of gravity also improves the handling of the racquet and reduces stress on the arm and wrist of the player during play, resulting in reduced player fatigue and injury occurrences during play. The new racquet design also incorporates a design that improves the aerodynamics of the racquet. The racquet is designed to reduce air friction during play which can both slow the speed and handling of the racquet and cause the racquet head to vibrate or rotate during play. The improved aerodynamics of the racquet are incorporated above the handle 20 of the racquet. Specifically, the throat 30 and head 40 of the racquet incorporates several design changes that greatly improve the aerodynamics of the racquet and also redistribute the weight of the racquet for better acceleration and control, earlier racquet preparation and easier directional changes on volleys without loss of power, creating a "glide effect." Thus, the racquet is more player friendly.

These improved features of the racquet are achieved by reducing the thickness and weight of the head of the tennis racquet. Referring to FIG. 1, the tennis racquet 10 is preferably designed to have a standard length of about 27 inches; however, the racquet may be designed to have other lengths. Handle 12 of racquet 10 is preferably a standard handle, but can incorporate various gripping elements to improve the grip during play. In one embodiment, the handle is 7 inches long. The base 22 of handle 20 may be thicker to improve racquet handling. Preferably, handle 20 has a substantially constant cross-sectional area; however, the cross-sectional area can be designed to become progressively smaller from the handle base 22 to handle top 24. The handle 20 may be solid or hollow. If the handle is hollow, the handle preferably contains a vibration damping material such as a foam. The handle may also include reinforcing components to increase the strength of the handle. Such reinforcing component may include graphite, graphite fibers, fiberglass fibers, boron containing components, etc.

Figure 4:
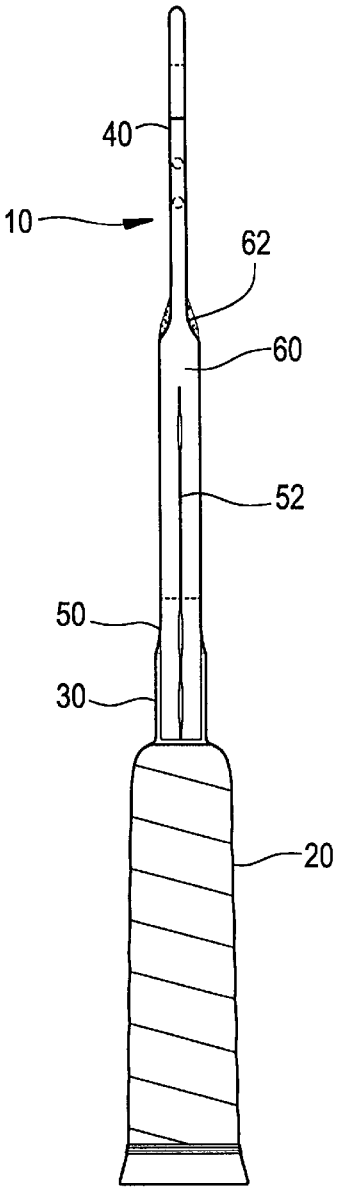
FIG. 4 is a side elevation view of the tennis racquet of FIG. 1.

Referring to FIGS. 1 and 4, the throat 30 of racquet 10 connects the top 24 of handle 20 to racquet head 40. The throat is preferably a hollow structure and is made of a light weight yet durable material; however, the throat may be designed to be a solid structure. The throat is preferably made of materials such as fiberglass, graphite, titanium, boron, Kevlar, aluminum, etc. If the throat is hollow, the throat is preferably injection filled with a light weight material such a polymer foam to reduce the vibration of the racquet during play. The throat preferably has a solid face to increase the rigidity of the racquet and to increase the structural integrity of the racquet; however, an opening, not shown, can be positioned in the throat for aesthetic purposes and/or to further reduce the weight of the racquet.

Referring to FIG. 4, throat 30 is significantly thinner than handle 20. Preferably, throat 30 has a thickness which is about 20–60 percent less and more preferably 40–60 percent less than the thickness of the handle. In one embodiment, the thickness of the throat is about 12–18 mm and more preferably about 14.5–15.5 mm. The thickness of the throat preferably remains substantially constant, but may be slightly decreased from the handle 20 to the racquet head 40. The front and back surfaces of the throat are preferably flat or slightly curved to reduce air friction. The sides of the throat are preferably flat but may be arcuate or angular for aesthetic purposes and to further increase the aerodynamics of the racquet.

Figure 2:
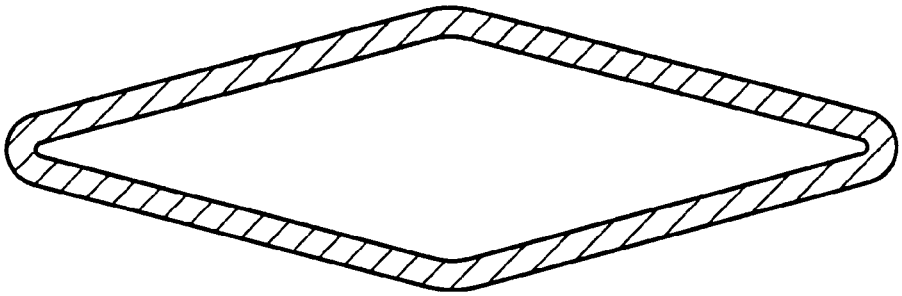
FIG. 2 illustrates a cross-section view taken along lines 2—2 of FIG. 1.

Referring now to FIGS. 1–4, racquet head 40 includes several unique design features that contribute to the superior aerodynamics and play of tennis racquet 10. Referring specifically to FIGS. 1 and 2, the racquet head is shown to have an oval design and form an oval playing area; however, many other designs can be used such as circular, rectangular, etc. The bottom section 50 of head 40 is shown to have a special cross-sectional design to maintain the rigidity and structural integrity of the racquet. This design is shown in FIG. 2. The cross-section of base section 50 of the head 40 preferably has a rhombus type shape. Preferably, the base section has a hollow interior but can be designed to be solid. This cross-sectional shape forms a ridge type structure 52 on the front 54, back, and side surface of the racquet head. As can be appreciated, other cross-sectional designs can be used to form one or more ridges on the front, back and/or side face of the racquet head. The ridge structure proceeds from the throat 30 and along both sides 56 of racquet head 40. The ridge structure terminates about 20–60 percent and more preferably 25–40 percent of the total length of the head.

The thickness of the bottom section 50 of the racquet head is designed to be thinner than the throat 30 as illustrated in FIG. 4. Preferably the bottom section of the head which includes the ridge structure has a substantially constant maximum thickness at the ridge; however, the thickness may be designed to slightly decrease as the distance increases from the throat 30. As shown in FIG. 1, the width of the racquet head increases until it reaches the racquet head middle section 60. After middle section 60, the racquet head preferably decreases until reaching top section 70 of racquet head 40. The decrease in width contributes to the aerodynamics of the racquet and the reduce head weight of the racquet. The thin edges and sloped surfaces of the bottom 50 of the head as shown in FIG. 2 also add to the aerodynamic design of the racquet. The hollow section of the bottom of the head may be injected with vibration reducing materials such as a polymer foam and/or include various types of reinforcing materials. The vibration reducing materials are preferably light weight and can be selected to increase the rigidity and/or structural integrity of the racquet head. In one preferable embodiment, the thickest point of the cross-section bottom section of the head is about 6–12 mm and more preferably 8–10 mm. The width of the cross-section of the bottom section ranges from about 40–60 mm to about 28–50 mm and more preferably from about 45–55 mm to about 30–45 mm. The base section of the head includes a multitude of side openings 58 to allow the racquet strings to be threaded in the racquet. A plastic sleeve 80 may be inserted in the opening 58 to help guide the string through the hole.

Figure 3A:
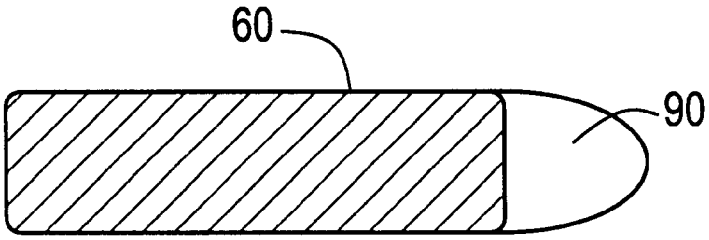
FIGS. 3*a–b* illustrate two different cross-sectional views taken along lines 3—3 of FIG. 1.
Figure 3B:
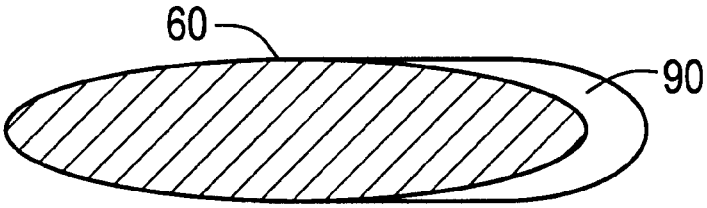

Referring now to FIGS. 1, 3*a–b* and 4, the middle section of racquet head 40 is designed to have a different cross-sectional shape and a thinner thickness and width than the bottom section 50 of the racquet head 40. Referring specifically to FIGS. 3*a–b,* two different preferred cross sections for the middle section of the head are illustrated. One cross-sectional design is an oval shape as shown in FIG. 3*b,* and the second design is a rectangular shape having a curved outer edge as shown in FIG. 3*a.* These two designs are preferable but not exclusive. The two preferred designs provide excellent structural integrity and rigidity even at very thin thickness and widths. The middle section of the head is preferably solid to maximize the strength and/or rigidity of the top section; however, it may be designed to be hollow and may be filled with a vibration reducing material such as a polymer foam. The vibration reducing material may also be selected to be light weight and/or add to the rigidity and/or structural integrity of the racquet head.

As shown in FIG. 4, the thickness of the middle section 60 of the head is designed to be thinner than the bottom section 50 of the head. The thickness of the middle section of the head is preferably designed to rapidly decrease to a thinner profile as shown in FIG. 4. The rapid width decreasing section 62 is preferably a solid component; however, the section may be partially hollow at the thicker portion and solid at the thinner portion. Once the middle section is reduced in thickness, the middle section preferably progressively decreases in thickness until reaching the top section 70 of racquet head 40; however, the middle section may be designed to have a substantially constant thickness throughout the thin portion of the middle section. In one embodiment, the thickness of the thin portion of the middle section of the head ranges from 7.5–9.75 mm to 6–9 mm and more preferably 7.5–9 mm to 7–8 mm. The thick section of the middle section preferably ranges from 7–12 mm and more preferably 8–10 mm. As shown in FIG. 1, the width of the middle section of the head progressively decreases until reaching the top of the head; however, other width designs can be used such as reducing the width along only a portion of the middle section of the head and maintaining the rest of the middle section of the head at a constant width. In one embodiment, the width of the middle section of the racquet head progressively decreases from 28–50 mm to 12–30 mm and more preferably 30–45 mm to 15–25 mm; however, the width can be maintained constant.

The top section 70 of the head preferably has a constant cross-sectional width and thickness and is preferably solid; however, slight design modifications can be employed. In addition, the top section of the head may include a hollow section to reduce the weight of the top of the head. The top section of the racquet is preferably the same thickness or thinness as the width of the middle section at the interface between the middle and top section of the head. Preferably, the thickness of the top section is about 7.5–9 mm and preferably about 7–8 mm. The width of the top section is preferably about 12–28 mm and more preferably about 18–22 mm. As shown in FIG. 1, the top section of the head includes multiple openings so that the racquet string can be strung through the racquet.

The top section of the racquet and preferably a portion of the middle section of the racquet may include a reinforcing element, not shown, such as a titanium strip and/or fiberglass fibers to strengthen the top of the racquet for increased durability and rigidity. The middle and/or top section of the head may also include a grommet guard 90 to protect the top and top section of the head from damage. The grommet guard is preferably made of a flexible and durable material such a plastic and/or rubber. The racquet head may include small openings in the face and/or back of the racquet head to receive damping elements which further reduce the vibration of the racquet during play.

The playing surface of the racquet head is preferably about 95–110 sq. in.; however other playing surface areas can be designed. The materials used for the racquet head may be the same or different from the materials used for the racquet throat 30.

The tennis racquet also preferably includes an improved string gripping surface. To improve gripping of the tennis ball during play, the strings are coated with a substance that strongly bonds to the strings and also grips a tennis ball during play. The improved gripping increases the ability to produce a top spin, backspin and improves general ball control. One such substance is a rubber and/or silicon compound that can be applied by an aerosol spray. The compound is designed to be applied in a thin coat and will preferably last two or three matches before another coating should be applied; however, the coating may be a thicker coating that is applied to the strings before the racquet is strung. The coating may also be formulated to be applied by a brush.

In summary, the new tennis racquet design includes an ultra thin profile, a lower center of gravity, and is very light and durable. This racquet design provides for less air resistance during play, greater maneuverability during play, creating a "glide effect," increased power during play, and results in less player fatigue during play. The racquet also allows for higher string tensions than obtainable with standard graphite and fiberglass racquets due to its rigidity and structural integrity.

The invention has been described with reference to preferred embodiments and alternatives thereof. It is believed that many modification and alterations to the embodiments disclosed will readily suggest themselves to those skilled in the art upon reading and understanding the description of the invention and drawings of the invention. It is intended to include all such modifications and alterations insofar as they come within the scope of the present invention.

I claim:

1. An improved racquet comprising a handle, a throat and a head, said throat having a top end, a bottom end, a front face and a back face, said handle connected to the bottom end of the throat, said head connected to the top end of said throat, said head including two arms, each arm having a front face, a back face, a bottom section, a middle section and a top section, said bottom section of said arm having a varying thickness and width on at least one portion of said bottom section, said top section of said arm having a substantially constant thickness and width, said bottom section of each of said arms includes a ridge extending upwardly from said front face of said head.

2. A racquet as defined in claim 1, wherein said front face and said back face of said throat being substantially solid.

3. A racquet as defined in claim 2, wherein said bottom section has a rhombus cross-sectional shape.

4. A racquet as defined in claim 3, wherein said bottom section of each of said arms having a greater thickness and width than said middle section of each of said arms, said middle section of each of said arms having a greater thickness and width than said top section of each of said arms.

5. A racquet as defined in claim 4, wherein said bottom section of each of said arms has a different cross-sectional shape than said middle section of each of said arms.

6. A racquet as defined in claim 5, wherein said middle section of each of said arms includes a lower, center and upper portion, said lower portion and said upper portion having a substantially constant width, said center portion including a section which reduces in thickness, said lower portion having a greater thickness than said upper portion.

7. A racquet as defined in claim 6, wherein said top section has a substantially solid cross section.

8. A racquet as defined in claim 7, wherein said bottom section includes a hard exterior shell filled with a vibration reducing compound.

9. A racquet as defined in claim 8, wherein said racquet has a center of gravity positioned below said racquet head.

10. A racquet as defined in claim 1, wherein said bottom section has a rhombus cross-sectional shape.

11. An improved racquet comprising a handle, a throat and a head, said throat having a top end, a bottom end, a front face and a back face, said handle connected to the bottom end of the throat, said head connected to the top end of said throat, said head including two arms, each arm having a front face, a back face, a bottom section, a middle section and a top section, said bottom section of said arm having a varying thickness and width on at least one portion of said bottom section, said top section of said arm having a substantially constant thickness and width, said bottom section of each of said arms having a greater thickness and width than said middle section of each of said arms, said middle section of each of said arms having a greater thickness and width than said top section of each of said arms.

12. A racquet as defined in claim 1, wherein said bottom section of each of said arms has a different cross-sectional shape than said middle section of each of said arms.

13. A racquet as defined in claim 1, wherein said middle section of each of said arms includes a lower, center and upper portion, said lower portion and said upper portion having a substantially constant width, said center portion including a section which reduces in thickness, said lower portion having a greater thickness than said upper portion.

14. A racquet as defined in claim 1, wherein said top section has a substantially solid cross section.

15. A racquet as defined in claim 1, wherein said racquet has a center of gravity positioned below said racquet head.

16. An improved tennis racquet having improved aerodynamics and weight distribution comprising a handle, a throat and a head, said throat having a top end, a bottom end, a front face and a back face, said handle connected to the bottom end of the throat, said head connected to the top end of said throat, said throat having a thickness of about 20–60 percent less than a thickness of said handle, said front face and said back face of said throat being substantially solid, said head including two arms, each arm having a front face, a back face, a bottom section, a middle section and a top section, said bottom section of each of said arms having a varying width on at least one portion of said bottom section, said bottom section including a ridge extending upwardly from said front face of said arm, said ridge extending about 20–60 percent of the total length of said head, said bottom section of said arm having a smaller thickness than said throat, said bottom section of said arm having a greater thickness and width than said top section of said arm, said racquet has a center of gravity positioned below said racquet head.

17. A tennis racquet as defined in claim 16, wherein said bottom section has a rhombus cross-sectional shape.

18. A tennis racquet as defined in claim 16, wherein said bottom section of each of said arms having a different cross-sectional shape than said middle section of each of said arms.

19. A tennis racquet as defined in claim 16, wherein said middle section of each of said arms includes a lower, center and upper portion, said lower portion and said upper portion having a substantially constant width, said center portion including a section which reduces in thickness, said lower portion having a greater thickness than said upper portion.

20. A tennis racquet as defined in claim 16, wherein said top section has a substantially solid cross section.

21. A tennis racquet as defined in claim 16, wherein said top section of each of said arms includes a reinforcing element to strengthen and rigidify said top section.

22. A tennis racquet as defined in claim 16, including a grommet guard secured to said top section of each of said arms.

23. A tennis racquet as defined in claim 16, wherein said top section of each of said arms having a substantially constant thickness and width.

24. A tennis racquet as defined in claim 16, wherein said bottom section of each of said bottom sections of said arms having a varying thickness on at least one portion of said bottom sections.

* * * * *